US007266977B2

(12) United States Patent
Zwyssig

(10) Patent No.: US 7,266,977 B2
(45) Date of Patent: Sep. 11, 2007

(54) RING HAVING TWO PARTS THAT CAN BE DISPLACED RELATIVE TO ONE ANOTHER

(75) Inventor: Josef Zwyssig, Twann (CH)

(73) Assignee: Cendres & Metaux SA, Beil (CH)

( * ) Notice: Subject to any disclaimer, the term of this patent is extended or adjusted under 35 U.S.C. 154(b) by 0 days.

(21) Appl. No.: 10/524,832

(22) PCT Filed: Aug. 18, 2003

(86) PCT No.: PCT/CH03/00555

§ 371 (c)(1),
(2), (4) Date: Feb. 18, 2005

(87) PCT Pub. No.: WO2004/017782

PCT Pub. Date: Mar. 4, 2004

(65) Prior Publication Data

US 2006/0150673 A1 Jul. 13, 2006

(30) Foreign Application Priority Data

Aug. 20, 2002 (EP) ..... 02405712

(51) Int. Cl.
*A44C 19/00* (2006.01)
*A44C 9/02* (2006.01)
*A44C 9/00* (2006.01)

(52) U.S. Cl. ..... 63/15; 63/15.1; 63/15.2; 63/15.3; 63/15.7; 63/15.4

(58) Field of Classification Search ..... 63/15.1–15.7, 63/31

See application file for complete search history.

(56) References Cited

U.S. PATENT DOCUMENTS

| | | | | |
|---|---|---|---|---|
| 1,324,524 | A * | 12/1919 | Silver | 235/123 |
| 4,224,894 | A * | 9/1980 | Haldemann | 116/209 |
| 5,701,765 | A * | 12/1997 | Cerqua | 63/15.4 |
| 5,873,265 | A * | 2/1999 | Simonnet | 63/28 |
| 6,032,485 | A * | 3/2000 | Steinberg | 63/15 |
| 6,101,843 | A * | 8/2000 | Nagano | 63/15.4 |
| 6,574,989 | B1 * | 6/2003 | Lampert | 63/15 |
| 2001/0020369 | A1 * | 9/2001 | Hirano | 63/15.4 |

FOREIGN PATENT DOCUMENTS

| | | |
|---|---|---|
| EP | 1 132 017 A | 9/2001 |
| GB | 2 092 392 A | 8/1982 |

* cited by examiner

*Primary Examiner*—J. J. Swann
*Assistant Examiner*—David Reese
(74) *Attorney, Agent, or Firm*—Foley and Lardner LLP

(57) ABSTRACT

The ring has at least two mutually rotatable parts, with a detent mechanism for respectively one of two mutually rotatable parts, and securing means. For improving the detent mechanism and the substantially play-free retention the detent mechanism is respectively provided in the intersecting plane (S) of two mutually rotatable parts and the mutually rotatable parts are secured by at least one springable element. Furthermore, if marks are provided on the surfaces of the ring, the most varied appearances can be altered and obtained by rotating one of the parts. This applies particularly if the surfaces of the parts are not even but wave-shaped.

6 Claims, 2 Drawing Sheets

RING HAVING TWO PARTS THAT CAN BE DISPLACED RELATIVE TO ONE ANOTHER

FIELD OF INVENTION

The present invention refers to a ring having at least two mutually rotatable parts, with a detent mechanism for respectively one of two mutually rotatable parts, and securing means.

BACKGROUND OF THE INVENTION

Such a ring is known from the European Patent Application No. 1,132,017, the ring having a detent mechanism, on one hand, and the ring parts being provided with retention means, on the other hand.

Furthermore, rings are known where parts are mutually displaceable or can be lifted off. As early as in the Middle Ages and later, rings having displaceable or removable or openable parts have existed, thereby allowing either to change the ring and to reveal other aspects or to keep small objects.

SUMMARY OF THE INVENTION

Based on this prior art, it is the object of the present invention to provide a ring having at least two mutually rotatable parts and offering the possibility of making multiple adjustments in at least one plane to reveal both changing esthetic aspects and information that may possibly be provided on the ring, the latter having a detent mechanism and a retention means for allowing a precisely positioning and substantially play-free rotation of the ring parts.

This is accomplished by a ring wherein the detent mechanism is respectively provided in the intersecting plane (S) of two mutually rotatable parts and the mutually rotatable parts are secured by at least one springable element.

BRIEF DESCRIPTION OF THE DRAWINGS

The invention will be explained in more detail hereinafter with reference to drawings of an exemplary embodiment.

DESCRIPTION OF THE PREFERRED EMBODIMENT

The ring described hereinafter is composed of two parts, but it will be apparent from the description that rings according to the invention may also comprise three or more parts.

Figure 2:
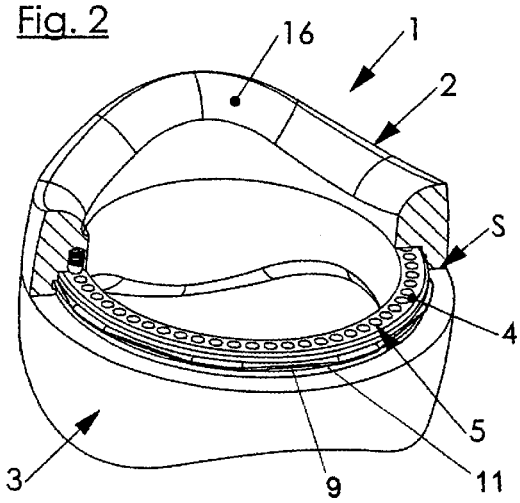
FIG. 2 shows the ring of FIG. 1 in a partly sectioned view.
Figure 3:
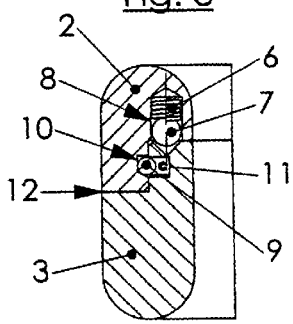
FIG. 3 shows a section according to line III/III in FIG. 4.

Ring 1 is composed of two parts 2 and 3 that are rotatable relative to one another. Both parts are wave-shaped on the outside with respect to its inner intersection plane resp. rotational plane S, so that the appearance of the ring continually changes as the two parts are rotated mutually. As appears in FIGS. 2 and 3, one of the parts, in this case part 3, is provided in the intersection plane with a detent ring 4 having detent holes 5. The other part, in the present example part 2, is provided with a ball 7 under the action of a spring 6, which may engage in one of detent holes 5, spring 6 and ball 7 being disposed in a corresponding bore 8 in part 2.

The two ring halves are secured by a springable washer 9 engaging in an annular groove 10 in part 2 and in an annular groove 11 in part 3, thereby securing the two parts to each other.

One aspect of this ring is that gap 12 between the two parts may be very thin due to the securing by spring means and thus hardly visible. However, it is understood that this gap may be enlarged and adorned, if desired.

Due to the fact that the ring is adjustable and lockable in a fine graduation by means of the detent mechanism, a variety of continually changing appearances may be obtained in accordance with the signs, shapes and other aspects that are provided.

This applies particularly in the case of wave-shaped or similarly designed surfaces 16 or 17 of the rings, while it is understood that different colors or engraved texts or stones with mounted portions etc. may also contribute to a continually changing appearance and that the mentioned decorations may also be provided on the front surfaces of the ring.

Figure 1:
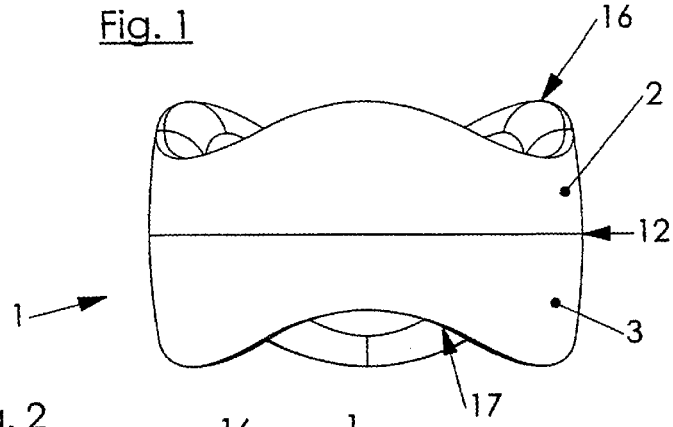
FIG. 1 shows an embodiment of a ring according to the invention in a lateral view.
Figure 4:
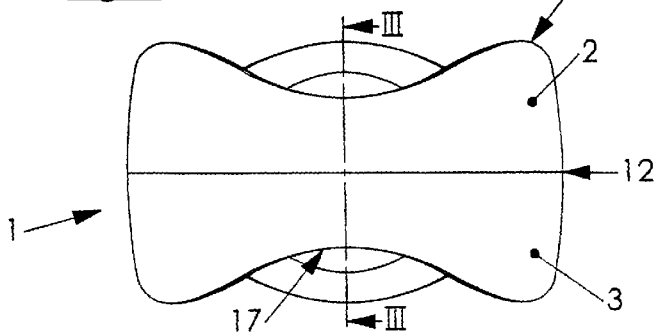
FIG. 4 shows the ring of FIG. 1 with the upper portion rotated by 120°.
Figure 5:
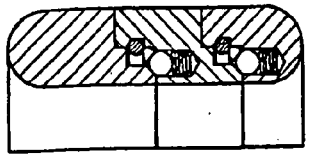
FIG. 5 shows a ring composed of more than two rotatable parts.
Figure 7:
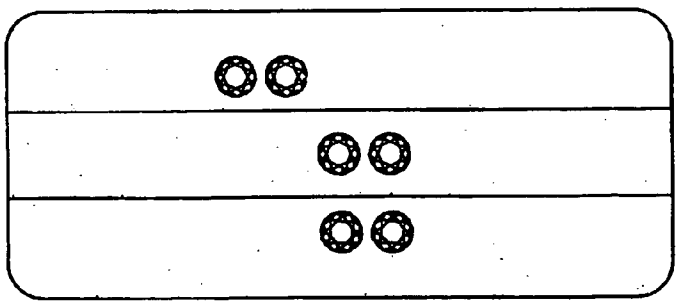
FIG. 7 shows a ring composed of more than two rotatable parts wherein the more than two rotatable parts are provided with decorations.
Figure 6:
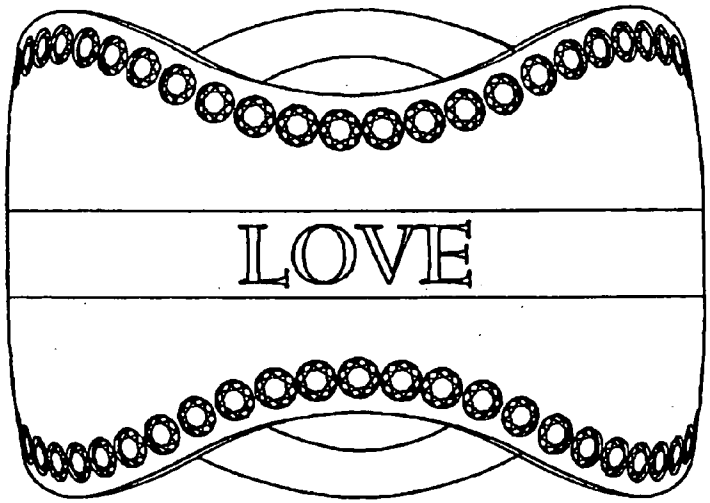
FIG. 6 shows a ring wherein its surface is provided with letters and/or decorations and/or precious stones.

In the present exemplary embodiment, the two ring parts 2 and 3 are identical in design and comprise three elevations with three dips, thereby forming surface structures 16 and 17, respectively. In FIG. 4, the upper part 2 has been rotated by 120° with respect to FIG. 1, and it is clearly apparent that the result is a completely different ring.

On this basis, a large number of variations are possible, i.e. the surfaces may comprise two or more than three elevations, and the parts of a ring may have the same or different numbers of elevations.

Of course, the ring may also have a simple design and only comprise parts having essentially straight surfaces that may e.g. be faceted.

As already mentioned in the introduction, a ring may also be composed of more than two parts, e.g. of a middle part having detent rings on both sides and of two outer parts with spring-loaded balls while the respective securing means are the same as previously described.

The detent mechanism is not limited to a detent ring with holes and a spring-loaded ball but may include other known detent means such as notches on one part and one tooth or a plurality of teeth on the other part, which need not necessarily be spring-loaded.

Furthermore, the mutually rotatable parts may be secured by other springable means, e.g. by springable elements provided on one part that engage in or behind elements or into annular grooves at the other part.

The invention claimed is:

1. A jewelry piece having at least two mutually rotatable parts, wherein the mutually rotatable parts are rotatable around a center line of the jewelry piece and in a plane, and at least two of said mutually rotatable parts define an intersecting jewelry piece plane (S), said jewelry piece having a detent mechanism for respectively one of said at least two mutually rotatable parts, and securing means, wherein the detent mechanism is respectively provided in the intersecting jewelry piece plane (S) of said at least two mutually rotatable parts and the mutually rotatable parts are secured by at least one springable washer inserted in respective annular grooves in the at least two mutually rotatable parts, wherein said detent mechanism and said at least one springable washer act perpendicular to said jewelry piece plane.

2. A jewelry piece according to claim 1, wherein one of the at least two mutually rotatable parts comprises, in the intersecting jewelry piece plane (S), a detent ring having detent holes, and another part, which is rotatable relative to the one of the at least two mutually rotatable parts, comprises a spring-loaded ball adapted to engage in one of the detent holes, said spring-loaded ball acting perpendicular to said intersecting jewelry piece plane (S).

3. A jewelry piece according to claim 1, wherein the jewelry piece is composed of more than two mutually rotatable parts.

4. A jewelry piece according to claim 1, wherein with respect to the intersecting plane (S), a plurality of external sides of the jewelry piece in said intersecting jewelry piece plane (S) are uneven when viewed laterally.

5. A jewelry piece according to claim 1, wherein a surface of the jewelry piece is provided with letters and/or decorations and/or precious stones.

6. A jewelry piece according to claim 1, wherein with respect to the intersecting plane (S), a plurality of external sides of the jewelry piece are wave-shaped.

* * * * *

UNITED STATES PATENT AND TRADEMARK OFFICE

CERTIFICATE OF CORRECTION

PATENT NO. : 7,266,977 B2
APPLICATION NO. : 10/524832
DATED : September 11, 2007
INVENTOR(S) : Josef Zwyssig It is certified that error appears in the above-identified patent and that said Letters Patent is hereby corrected as shown below:

On the title page item (73),
The Assignee's name should read "Cendres & Métaux SA, Biel (CH)".

Signed and Sealed this

Twenty-fourth Day of March, 2009

JOHN DOLL
*Acting Director of the United States Patent and Trademark Office*